US008990975B1

(12) United States Patent
Harden et al.

(10) Patent No.: US 8,990,975 B1
(45) Date of Patent: Mar. 31, 2015

(54) USER ASSISTANCE APPARATUS AND METHODS

(76) Inventors: Jerrell W. Harden, Banks, AL (US); Russell J. Harden, Banks, AL (US)

( * ) Notice: Subject to any disclaimer, the term of this patent is extended or adjusted under 35 U.S.C. 154(b) by 353 days.

(21) Appl. No.: 13/406,277

(22) Filed: Feb. 27, 2012

(51) Int. Cl.

| | |
|---|---|
| ***A61G 5/02*** | (2006.01) |
| ***A61G 7/10*** | (2006.01) |
| *A61G 5/10* | (2006.01) |
| *A47C 3/18* | (2006.01) |

(52) U.S. Cl.

CPC ..... *A61G 7/1076* (2013.01); *A61G 5/104* (2013.01); *A61G 7/1067* (2013.01); *A47C 3/18* (2013.01); *Y10S 414/134* (2013.01); *Y10S 482/904* (2013.01)

USPC ..... 5/81.1 RP; 5/81.1 R; 5/86.1; 280/250.1; 297/217.7; 297/344.22; 414/921; 482/904

(58) Field of Classification Search

CPC ..... A61G 7/1076; A61G 7/1067; A61G 2200/36; A61G 5/104; A47C 3/18; A47C 7/506; Y10S 297/10; Y10S 414/134

USPC ..... 5/81 RP, 81.1 R, 86.1, 81.1 HS, 662, 5/507.1; 280/250.1, 304.1; 297/344.22, 297/344.23, 217.7, DIG. 4, DIG. 10; 414/921; 482/114, 115, 118, 119, 904

See application file for complete search history.

(56) References Cited

U.S. PATENT DOCUMENTS

| | | | | | |
|---|---|---|---|---|---|
| 2,757,388 | A | * | 8/1956 | Chisholm | 5/507.1 |
| 3,151,910 | A | * | 10/1964 | Larson | 297/344.22 |
| 3,911,509 | A | * | 10/1975 | Fleckenstein | 5/507.1 |
| 4,056,886 | A | * | 11/1977 | Doelling | 33/10 |
| 4,243,147 | A | | 1/1981 | Twitchell et al. | |
| 4,279,043 | A | * | 7/1981 | Saunders | 5/81.1 RP |
| 4,352,218 | A | | 10/1982 | Lundberg | |
| 4,415,202 | A | | 11/1983 | Pew | |
| 4,639,955 | A | | 2/1987 | Carminati et al. | |
| 4,809,804 | A | * | 3/1989 | Houston et al. | 180/65.51 |
| 4,941,799 | A | * | 7/1990 | Gordon et al. | 414/678 |
| 4,971,392 | A | | 11/1990 | Young | |
| 4,999,862 | A | * | 3/1991 | Hefty | 5/87.1 |
| 5,031,912 | A | * | 7/1991 | Vaughn et al. | 482/118 |
| 5,046,782 | A | | 9/1991 | Lundeen | |
| 5,054,137 | A | * | 10/1991 | Christensen | 5/81.1 RP |
| 5,158,188 | A | | 10/1992 | Nordberg | |
| 5,183,133 | A | | 2/1993 | Roy et al. | |
| 5,333,333 | A | | 8/1994 | Mah | |
| 5,418,988 | A | | 5/1995 | Iura | |

(Continued)

FOREIGN PATENT DOCUMENTS

| | | | |
|---|---|---|---|
| CN | 2738646 | Y | 11/2005 |
| CN | 201360767 | Y | 12/2009 |

*Primary Examiner* — Nicholas Polito
*Assistant Examiner* — David R Hare
(74) *Attorney, Agent, or Firm* — Bush Intellectual Property Law; Kenneth M. Bush

(57) ABSTRACT

A user assistance apparatus and system is disclosed. The apparatus and system may include a base and a platform rotatably positionable about the base. A lift assist chair may be disposed upon the platform, and handrails may be attached to the platform such that the handrails rotate with the platform. The handrails extend from the platform to define an entry, and the handrails are configured to assist a user as the user passes between the entry and the lift assist chair. Fixtures may be disposed in a generally curved arrangement to cooperate with the entry as the platform is rotatably positioned about the base. Related methods of use are also disclosed.

16 Claims, 6 Drawing Sheets

(56) References Cited

U.S. PATENT DOCUMENTS

| | | | | |
|---|---|---|---|---|
| 5,524,303 | A * | 6/1996 | Palmer et al. | 5/81.1 RP |
| 5,690,385 | A | 11/1997 | Feldman et al. | |
| 5,735,002 | A * | 4/1998 | Kistner | 5/81.1 HS |
| 5,816,655 | A | 10/1998 | Hoegh | |
| 5,895,093 | A * | 4/1999 | Casey et al. | 297/344.23 |
| 6,119,287 | A * | 9/2000 | Phillips | 5/81.1 RP |
| 6,179,076 | B1 | 1/2001 | Fernie et al. | |
| 6,253,497 | B1 | 7/2001 | Gekler et al. | |
| 6,568,646 | B2 * | 5/2003 | Wess et al. | 248/349.1 |
| 6,679,510 | B2 | 1/2004 | Perena | |
| 7,040,248 | B1 * | 5/2006 | Whitfield | 114/364 |
| 7,165,276 | B2 * | 1/2007 | Hahn et al. | 5/81.1 RP |
| 7,191,477 | B2 * | 3/2007 | Hahn et al. | 5/81.1 RP |
| 7,237,491 | B2 | 7/2007 | Faucher et al. | |
| 7,303,049 | B1 | 12/2007 | Greenlee | |
| 7,617,635 | B2 | 11/2009 | Jacobs et al. | |
| 7,892,156 | B2 * | 2/2011 | Marcantonio | 482/128 |
| 7,938,756 | B2 * | 5/2011 | Rodetsky et al. | 482/69 |
| 8,302,221 | B1 * | 11/2012 | Camp, Jr. | 5/81.1 RP |
| 8,920,292 | B1 * | 12/2014 | Myers et al. | 482/57 |
| 2006/0264306 | A1 * | 11/2006 | Tischler et al. | 482/148 |
| 2009/0257855 | A1 * | 10/2009 | Iannelli | 414/540 |
| 2009/0273163 | A1 | 11/2009 | Sorenson | |
| 2010/0187395 | A1 | 7/2010 | Callahan | |

* cited by examiner

USER ASSISTANCE APPARATUS AND METHODS

FIELD OF THE INVENTION

The present disclosure relates to apparatus that assist those with limited mobility and related methods.

BACKGROUND OF THE INVENTION

The infirm, the elderly, the handicapped may have limited mobility, and may need assistance in standing and walking. Such individuals may wish to be independent, as least as much as their particular conditions may allow. Independence including the ability to feed oneself, bathe, utilize a toilet, wash ones own clothes, and so forth may be important for quality of life and may enhance longevity as well as the individual's dignity. The individual's ability to care for oneself may reduce burden on other caregivers such as family members.

While various apparatus have been developed to assist those with limited mobility, there remains a need for improved apparatus as well as related methods that may allow for self-care by a person with limited mobility.

BRIEF SUMMARY OF THE INVENTION

These and other needs and disadvantages of the related art may be overcome by the apparatus, systems, and methods disclosed herein. Additional improvements and advantages may be recognized by those of ordinary skill in the art upon study of the present disclosure.

A user assistance apparatus and system is disclosed herein. In various aspects, the apparatus and system may include a base, and a platform rotatably positionable about the base. A chair may be disposed upon the platform, and, in various aspects, the chair may be configured as a lift assist chair, recliner chair, or other chair. Handrails may be attached to the platform such that the handrails rotate with the platform. The handrails extend forth from the platform to define an entry, and the handrails are configured to assist a user as the user passes between the entry and the chair, in various aspects. Fixtures are disposed in a generally curved arrangement to cooperate with the entry as the platform is rotatably positioned about the base, in various aspects.

Methods of use of the systems and apparatus are disclosed herein. In various aspects, the methods may include the steps of rotating a platform with a chair positioned thereupon, the platform being rotatably mounted upon a base, traversing by a user between the chair and a perimeter, the user grasping parallel handrails mounted upon the platform and extending generally between the chair and the perimeter, positioning the user between a standing position and a sitting position using the chair with the chair being configured as a lift chair, orienting an entry defined by the handrails with a fixture selected from a plurality of fixtures disposed in a generally semicircular arrangement about the perimeter, and accessing the fixture by the user with the entry so oriented, the user passing between the handrails from the chair to the entry.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1:
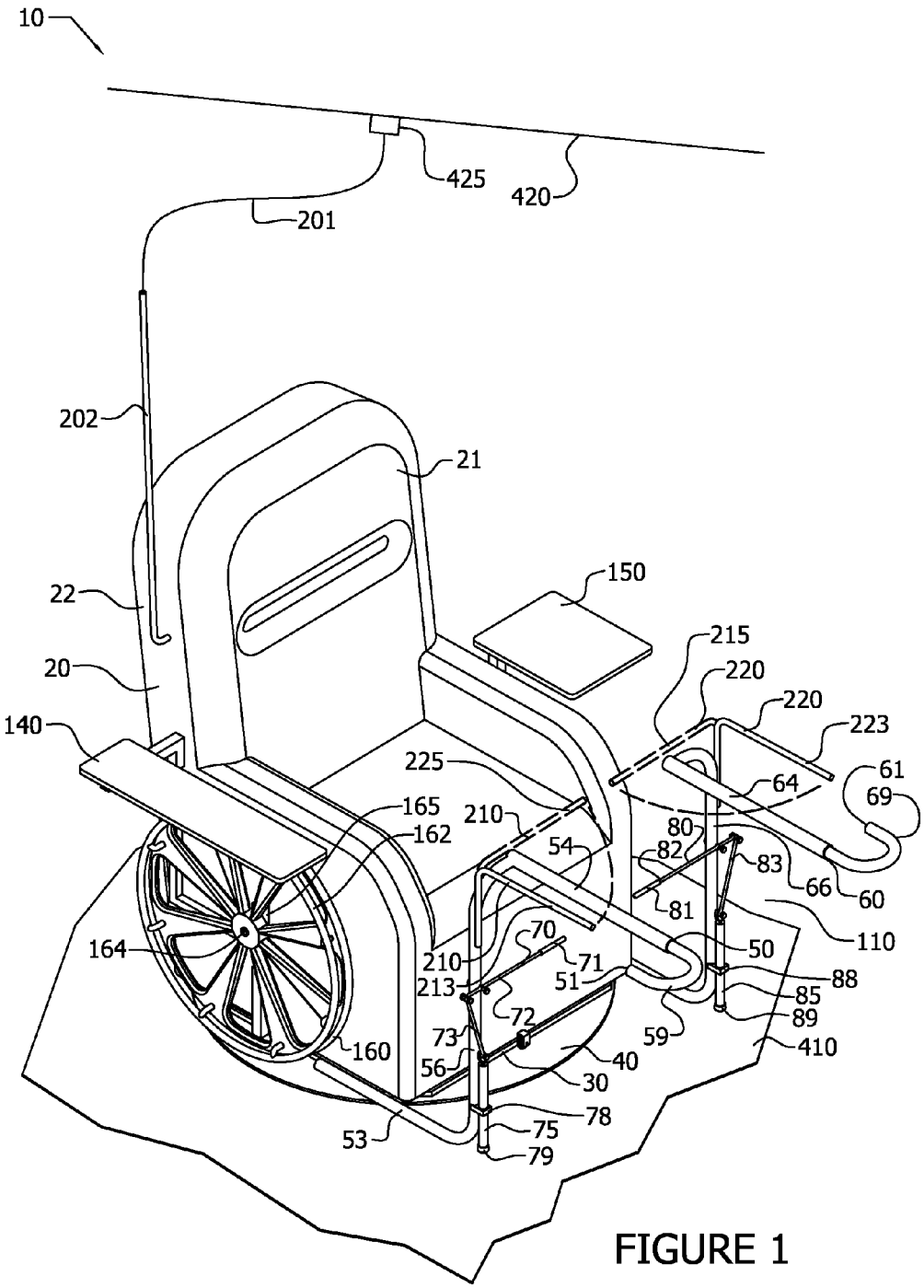
FIG. 1 illustrates by perspective view an exemplary implementation of portions of a user assistance apparatus.

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof.

DETAILED DESCRIPTION OF THE INVENTION

Apparatus including systems for the assistance of a user having limited mobility are disclosed herein. In various aspects, the apparatus includes a platform rotatably secured to a base. Handrails are attached to the platform, and a chair with front oriented toward the handrails is positioned upon the platform. The handrails extend forth from the platform and are adapted to assist a user as the user passes between the entry formed by handrails and the chair. The chair, the pathway formed between the handrails, and the entry to the pathway between the handrails may be oriented by rotation of the platform about the base. Various fixtures may be disposed about a periphery defined by the entry as the platform is rotated about the base. The fixtures may be organized in a generally curved arrangement to align with the entry as the platform is rotatably positioned about the base, and the user may rotate the platform to orient the entry with a particular fixture that the user desires to access.

The fixtures, in various aspects, may include a bed, equipment for cooking such as a cook top, microwave oven, and refrigerator, equipment for cleaning such a sink, clothes washer, and clothes dryer, equipment for communication such as a television, radio, computer, and telephone, and equipment for personal hygiene such as a toilet and a bathing facility. With the user seated upon the chair, the user may access the fixture by rotating the platform such that the entry is oriented with the fixture that the user desires to access. In various aspects, the chair may be configured as a lift assist chair that may assist the user in rising from a sitting position into a standing position. The user may then pass between the chair and the fixture through the pathway assisted by the handrails to access the desired fixture, and may do so by walking. In various aspects, the handrails may be outwardly extensible with respect to the platform, so that the user may adjust the length of the handrail to access various fixtures, as necessary. In various aspects, a trolley rail may pass overhead generally parallel to the handrails, and the user may be secured to the trolley rail by a harness movably connected thereto such that the user is supported, at least in part, by the trolley rail via the harness connected thereto. Related methods of use of the apparatus for the assistance of a user having limited mobility are also disclosed herein.

FIG. 1 illustrates portions of an implementation of user assistance apparatus 10. As illustrated in FIG. 1, user assistance apparatus 10 includes platform 30, which is rotatably connected to base 40. Base 40, as illustrated, rests upon floor 410, and chair 20 rests upon platform 30. Floor 410 may be a floor, deck, or other surface. Chair 20 may be formed as a lift assist chair 21 adapted to assist a user to rise from a seated position into a standing position as chair 20 is positioned from seated chair position 22 to lifted chair position 24 (see FIG. 4). As illustrated in FIG. 1, chair 20 is positioned in seated chair position 22, and the user may be seated in the seated position in chair 20 when chair 20 is in the seated chair position 22. Chair 20, as illustrated, is oriented such that the user faces pathway 107 when seated in chair 20.

Wheel 160 is rotatably secured to mount 165 via axle 164, and mount 165, in turn, is secured to platform 30. Wheel 160 is engaged with base 40 such that rotation of wheel 160 causes rotation of platform 30 about base 40, although wheel 160 may be engaged with floor 410 in other implementations. Wheel 160 includes rail 162 that can be gripped by the user to allow the user to rotate wheel 160 in order to rotate platform 30 including chair 20.

As illustrated in FIG. 1, handrails 50, 60 extend forth from platform 30 with portions of handrails 50, 60 positioned such that the user may grasp handrails 50, 60 one on each side as the user traverses pathway 107 (see FIG. 2) between chair 20 and entry 110 by walking. Handrail sections 59, 69 are slidably engaged internally with handrail sections 54, 64 of handrails 50, 60, respectively, so that handrail sections 59, 69 may be positioned at desired positions and then locked into engagement with handrail sections 54, 64 at the desired positions. For example, handrail sections 59, 69 may be extended forth from handrail sections 54, 64 and locked in position to extend handrails 50, 60, or handrail sections 59, 69 may be retracted into handrail sections 54, 64 and then locked in this retracted position in order to minimize the length of handrails 50, 60. Accordingly, the length of pathway 107 may be adjusted by extension or retraction of handrail sections 59, 69 and then locking handrail sections 59, 69 at the desired positions.

As illustrated in FIG. 1, brake mechanisms 70, 80 are placed about user assistance apparatus 10 to control rotation of platform 30 about base 40. As illustrated in FIG. 1, brake mechanisms 70, 80 are positioned about portions of handrails 50, 60, respectively, but brake mechanisms 70, 80 may be positioned in other locations about base 40 or platform 30, and more or fewer brake mechanisms, such as brake mechanisms 70, 80, may be provided, in other implementations. Brake mechanisms 70, 80 may be operable between a released condition 72, 82 and an engaged condition 74, 84, respectively (see FIGS. 3A & 3B). With braking mechanisms 70, 80 in released condition 72, 82, platform 30 may rotate about base 40. Handles 71, 81 of brake mechanism 70, 80 in released condition 72, 82, respectively, are oriented to block pathway 107 to prevent the user from passing between chair 20 on platform 30 and pathway 107 between handrails 50, 60 (see FIG. 2) when the platform might rotate. Foot ends 79, 89 of foot members 75, 85, of brake mechanisms 70, 80, respectively, are set apart from engagement with floor 410 when brake mechanisms 70, 80 are in released condition 72, 82.

With brake mechanisms 70, 80 in engaged conditions 74, 84, respectively, platform 30 is fixed so that platform 30 cannot rotate about base 40. Handles 71, 81 of brake mechanism 70, 80, respectively, are positioned generally to allow the user passage between chair 20 on platform 30 and pathway 107 between handrails 50, 60. Accordingly, handles 71, 81 function as safety devices that prevent the user from passing between chair 20 and pathway 107 when platform 30 may rotate, while allowing the user to pass between chair 20 and pathway 107 when platform 30 is held fixed by brake mechanisms 70, 80. This may prevent injury to the user caused by the inadvertent rotation of platform 30.

Figure 2:
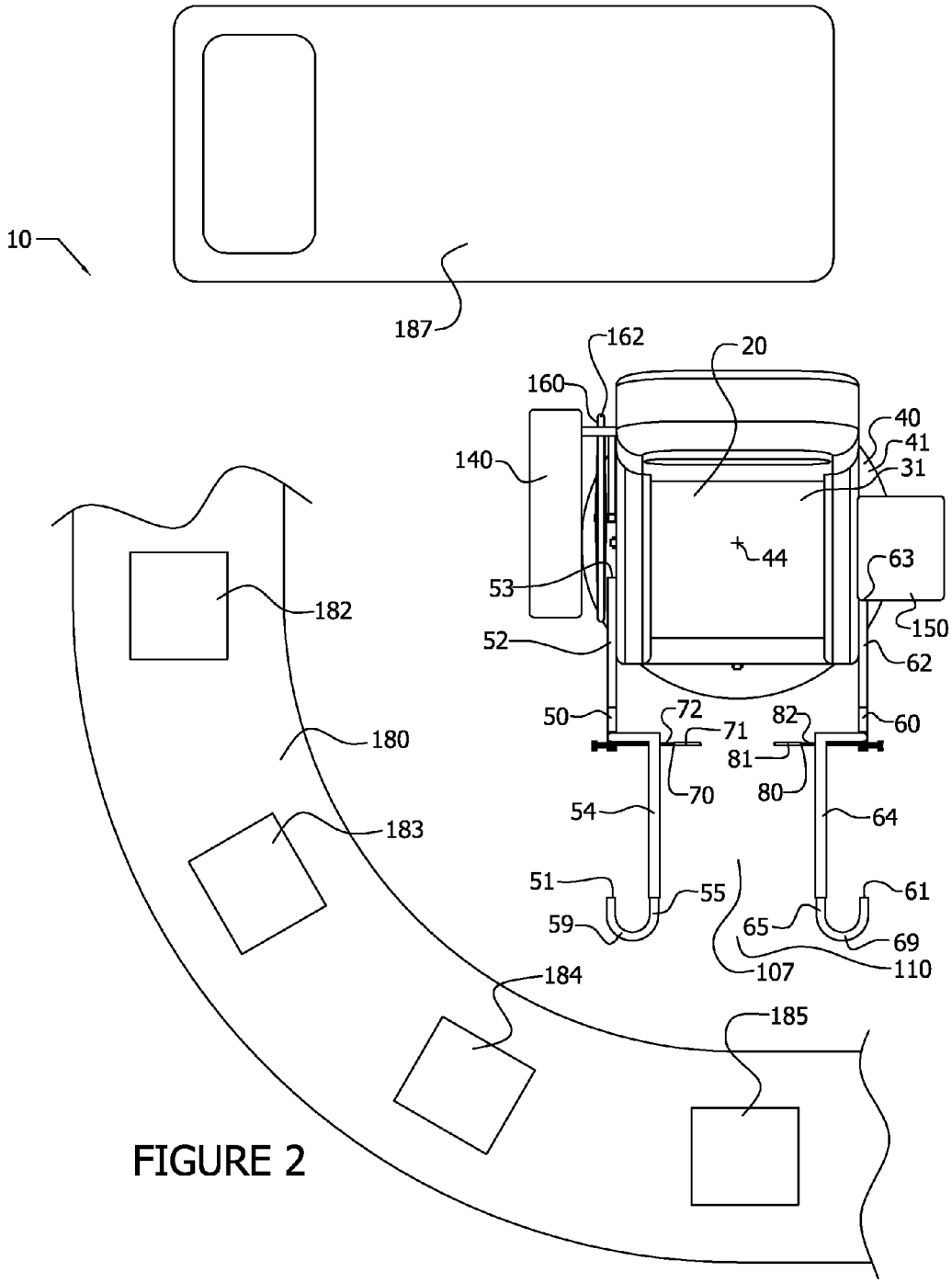
FIG. 2 illustrates by plan view portions of the exemplary implementation of the user assistance apparatus.

FIG. 2 illustrates portions of user assistance apparatus 10 including base 40, platform 30, and handrails 50, 60. As illustrated in FIG. 2, platform 30 is rotatably secured to base 40 about axle 44. In this illustration, chair 20 is placed above axle 44, which is indicated by the +. With base 40 resting upon floor 410, platform 30 may rotate about axle 44 to rotate about base 40. Portions of handrail sections 52, 62 of handrails 50, 60 proximate ends 53, 63, respectively, are secured to platform 30 so that handrails 50, 60 rotate about base 40 in conjunction with the rotation of platform 30. Handrail sections 54, 64 of handrails 50, 60 are elevated with respect to platform 30 as are handrail sections 59, 69 that may be extended forth from handrail sections 54, 64, respectively, to allow the user to grip handrails 50, 60 as the user traverses pathway 107 generally between platform 30 including chair 20 resting thereupon and entry 110. The user may traverse pathway 107 by walking with assistance from handrails 50, 60.

Handrail 50 doubles back upon itself generally proximate end 51 to form U-shaped section 55 which defines a U-shape generally in the horizontal plane, and handrail 60 doubles back upon itself generally proximate end 61 to form U-shaped section 65 which defines a U-shape generally in the horizontal plane. U-shaped sections 55, 65 may provide additional portions of handrails 50, 60, respectively, generally proximate entry 110 for the user to grip when entering or exiting entry 110 of pathway 107. The curved portions of U-shaped sections 55, 65 may guide the user through entry 110. U-shaped sections 55, 65 are presented to the user and ends 51, 61 of rails 50, 60 are turned away from the user as the user enters or exits entry 110, which may prevent trauma to the user as could be caused by the user bumping against squared edges, corners, ends, and so forth. Instead, rounded surfaces of U-shaped sections 55, 65 are presented to the user that the user may bump against, in this implementation. Sections 55, 65 could have other rounded, blunt, knobbed, or similar shapes to protect the user, in various other implementations.

Base 40 may be positioned proximate curved counter 180 such that handrails 50, 60 extend forth to engage curved counter 180 to provide access between curved counter 180 and chair 20 via pathway 107. Counter 180 may be generally curved to conform to an arc through which entry 110 formed by handrails 50, 60 passes as platform 30 is rotated about base 40. Fixtures 182, 183, 184, 185 including utilities may be located in a curved arrangement about counter 180. Fixtures 182, 183, 184, 185 may include, for example, a sink, refrigerator, microwave oven, cook top, oven, dishwasher, laundry facilities, or other appliances and utilities that may allow for the user's self-care. Various numbers and types of fixtures may be provided about counter 180 according to the needs and desires of the user. Additional fixtures that, for example, rest upon floor 410, are suspended from a ceiling, attached to walls, or placed about other tables, may be disposed generally in a curved arrangement about base 40, in various implementations.

The user may access a fixture selected from fixtures 182, 183, 184, 185 by rotating chair 20 in combination with platform 30 such that entry 110 aligns with the selected fixture. The user may then traverse pathway 107 generally between chair 20 and the selected fixture in order to access the selected fixture. Fixture 187, which may include a bed as well as bathing facilities, washing facilities, or toilet facilities, is positioned within the ambit of handrails 50, 60 and entry 110, as platform 30 is rotated about base 40. The user may rotate chair 20 on platform 30 about base 40 to align entry 110 with fixture 187. With entry 110 aligned with fixture 187, the user may pass from fixture 187 to chair 20 via pathway 107. The length of pathway 107 and the position of entry 110 may be adjusted by extension of handrail sections 59, 69 that may be extended forth from handrail sections 54, 64 of handrails 50, 60, respectively. Handrail sections 59, 69 may be extended forth from handrail sections 54, 64 or withdrawn into handrail sections 54, 64, respectively, as required, to adjust the length of handrails 50, 60 in order to allow the user access to various portions of counter 180 including fixtures 182, 183, 184, 185, to access fixture 187, or to access other fixtures disposed about base 40 with assistance from handrails 50, 60.

Table 150, as illustrated, is secured about platform 30, to provide the user with a surface for eating and so forth as the user is seated in chair 20. Table 150 may rotate in front of the user to provide a tabular surface in front of the user. Table 150 may also rotate over a user positioned on a bed located adjacent chair 20 for eating, writing, and the like. Table 150 may be adjustable vertically to allow the user to position table 150 at a desirable height. Table 140 is also provided about platform 30, and one or more electrical outlets (not shown) are provided about platform 30 so that various electrically powered devices, such as cooking devices, radios, televisions, and computers, may be utilized by the user. Both tables 140, 150 rotate with platform 30 and chair 20 placed thereupon.

Electrical pathways 201 that pass to chair 20, table 140, or table 150 to provide electrical power thereto may be configured so as not to become twisted or entangled as platform 30 is rotated about base 40. For example, as illustrated in FIG. 1, electrical pathway 201 passes from receptacle 425 on ceiling 420 through mast 202 to chair 20, table 140, 150, and so forth to flow mains electrical power from the receptacle 425 to various motors, electrical outlets, and other electrical devices disposed about the chair 20, table 140, 150, or otherwise disposed about user assistance apparatus 10. Electrical pathway 201 may be any of various electrical wires, cords, or other electrically transmissive pathways. Mast 202, in this implementation, is a rigid hollow member that contains portions of electrical pathway 201 therein to prevent the user from being entangled with electrical pathway 201. Electrical power may be flowed via electrical pathways having other configurations such as through the base 40, platform 30, or both base 40 and platform 30, in other implementations.

In some implementations, a brace (not shown) may extend from table 140 to end 53 of handrail 50 to support table 140. A small table (not shown) may be pivotally secured to the brace such that the user may pivot said small table into such position as the user may find desirable. Said small table may tilt in some implementations.

Figure 3A:
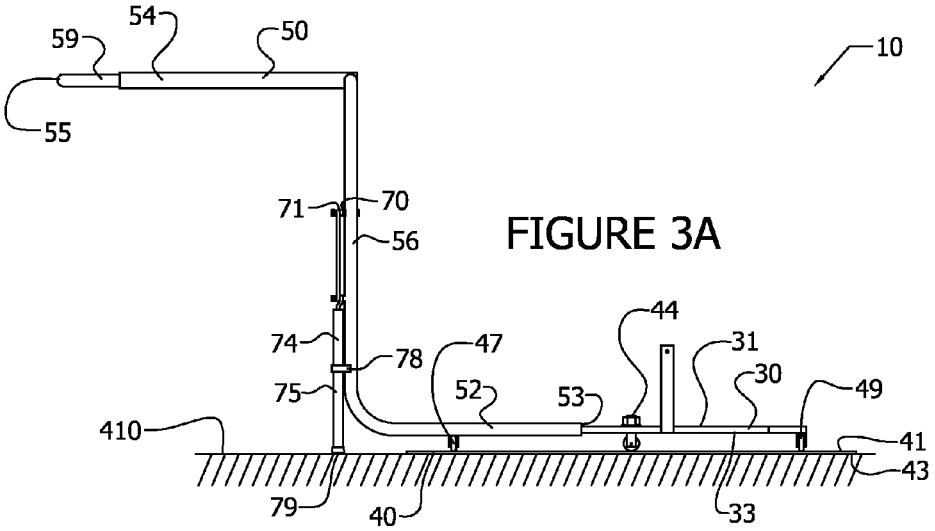
FIG. 3A illustrates by elevation view portions of the exemplary implementation of the user assistance apparatus.

FIG. 3A illustrates portions of user assistance apparatus 10 including platform 30 rotatably secured to base 40 with handrail 50 extending forth from platform 30. As illustrated in FIG. 3A, platform 30 is rotatably secured to base 40 via axle 44 about which platform 30 rotates. Rollers 47, 49, in this implementation, are placed between surface 33 of platform 30 and surface 41 of base 40 to support platform 30 as platform 30 rotates about axle 44. In various implementations, various numbers and types of rollers, including balls, bearings, and so forth, may be positioned between platform 30 and base 40 to facilitate the rotation of platform 30 about base 40. Surface 43 of base lies against floor 410, as illustrated.

Portions of handrail section 52 proximate end 53 of handrail 50 are secured to platform 30 for example, by welding, various mechanical connections such as bolts, brackets, or combinations thereof, in various implementations. Handrail section 56 is aligned vertically, as shown, and connects handrail section 52, which is generally aligned horizontally with base 40, to handrail section 54, which is also generally aligned horizontally. Handrail sections 54, 59 including U-shaped section 55 are elevated with respect to surface 31 of platform 30 at a height where handrail sections 54, 59 may be grasped by the user. Handrail section 59 may be extended from handrail section 54 to provide additional length of handrail 50 for the user to grasp. Handrail 60 may be formed in manner similar to that of handrail 50 as illustrated in FIG. 3A.

The user may stand in pathway 107 and push against either handrail 50 or handrail 60 to rotate the platform 30. An adjustable brake (not shown), in some implementations, may cooperate with wheel 160 to allow the user to adjust the rotational resistance of wheel 160. In other implementations (not shown), the adjustable brake may be formed as an adjustable spring-loaded brake lining pressing from platform 30 against base 40 to control the resistance of the rotation of platform 30 about base 40.

The user may exercise by rotating the platform with the rotational resistance of the platform 30 adjusted by adjustment of the adjustable brake as the user desires. The user may adjust the adjustable brake to adjust the rotational resistance of wheel 160 or the pressure of the spring-loaded brake lining against the base 40 to the desired amount such that platform 30 rotates about base 40 with resistance as chosen by the user. The user may rotate platform 30 by pushing upon handrail 50, 60, 210, 220 to reposition platform 30 along with handrails 50, 60, 210, 220 attached thereto, and may set the adjustable brake to provide essentially no rotational resistance when so rotating platform 30. The user may set the adjustable brake to provide a chosen amount of rotational resistance, and the user may then exercise by pushing upon handrail 50, 60, 210, 220 to rotate platform 30 about base 40 while working against the chosen resistance of the adjustable brake.

Figure 3B:
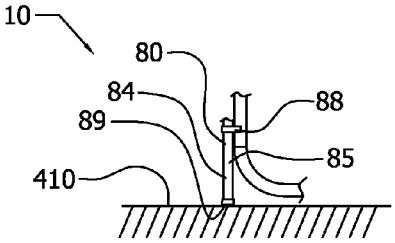
FIG. 3B illustrates by elevation view portions of the exemplary implementation of the user assistance apparatus of FIG. 1.
Figure 3C:
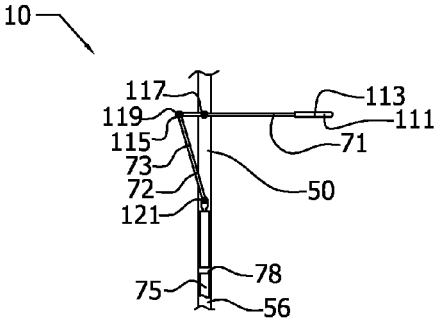
FIG. 3C illustrates by elevation view portions of the exemplary implementation of the user assistance apparatus of FIG. 1.

Brake mechanism 70, as illustrated in FIGS. 3A and 3C, is attached to handrail 50, and brake mechanism 70 may be attached to handrail 50 where handle 71 of brake mechanism 70 may be accessed by the user while the user is occupying chair 20. In this implementation, handle 71 mechanically cooperates with foot member 75 through link 73. The user may operate brake mechanism 70 between released condition 72 and engaged condition 74, respectively, by motioning of handle 71, which lifts foot end 79 of foot member 75 from engagement with floor 410 or forces foot end 79 of foot member 75 into engagement against floor 410. As illustrated in FIG. 3A, brake mechanism 70 is in engaged condition 74 wherein foot end 79 of foot member 75 is engaged with floor 410, which holds platform 30 fixed with respect to floor 410 and thus in fixed position about base 40. With brake mechanism 70 in engaged condition 74, handle 71 is generally oriented vertically in alignment with handrail section 56 of handrail 50 to be out of the way of the user as the user passes between chair 20 and pathway 107, as illustrated.

Handrail sections 210, 220, as illustrated in FIG. 1, are rotatably connected to handrail sections 56, 66, of handrails 50, 60, respectively, to rotate generally in the horizontal plane between positions 213, 225 and between 223, 215. Handrails sections 210, 220 may be rotated into positions 213, 223, respectively and locked in positions 213, 223. With handrail sections 210, 220 locked in positions 213, 223, the user may pass through pathway 107 unimpeded by handrail sections 210, 220. Handrail sections 210, 220 may provide additional surfaces for the user to grasp to aid the user while the user is within pathway 107. The user may push against handrail sections 54, 64 and 210, 220 to rotate platform 30 about base 40. Handrail sections 210, 220 may be rotated into positions 225, 215 (illustrated in phantom), and handrail sections 210, 220 may be locked in positions 225, 215, respectively. Handrail sections 210, 220 when locked in positions 225, 215 form a barrier across pathway 107, for example, to prevent the user from falling off of chair 20 into pathway 107, or to prevent the user from attempting to pass through pathway 107 when platform 30 is free to rotate about base 40 such as when brake mechanisms 70, 80 are in released condition 72, 82, respectively. Handrail sections 210, 220 prevent a user from inadvertently tripping over brake mechanisms 70, 80 while exercising in pathway 107. Handrail sections 210, 220 also provide greater stability for a user exercising in pathway 107 because the user can push on handrail sections 54 and 210 (in position 225) or handrail sections 64 and 220 (in position 215) at the same time.

FIG. 3C illustrates brake mechanism 70 in detail. Brake mechanism 70 includes handle 71, link 73, and foot member 75 that cooperate mechanically with one another as brake mechanism 70 is operated between released condition 72 and engaged condition 74. As illustrated in FIG. 3C, handle 71 of brake mechanism 70 include grip 111 at end 113 that provides a handhold for the user to grasp handle 71 in order to manipulate handle 71. End 115 of handle 71 pivots about pin 117. Link 73 is pivotally connected to handle 71 and to foot member 75 by connector pins 119, 121, respectively. Foot member 75 is slidably engaged with bracket 78. Link 73 transmits the position of handle 71 into a corresponding position of foot member 75. As illustrated, motioning of handle 71 about pin 117 causes movement and rotation about connector pins 119, 121 of link 73 thereby transmitting the motions of handle 71 to foot member 75, which slides in bracket 78 in correspondence to the motioning of handle 71. Accordingly, brake mechanism 70 may be operated between released condition 72 in which foot end 79 of foot member 75 is positioned above floor 410 and engaged condition in which foot end 79 of foot member 75 is biased against floor 410 by positioning of handle 71.

As illustrated in FIG. 3C, brake mechanism 70 is in released condition 72, and handle 71 is generally perpendicular to handrail section 56 of handrail 50 to extend outward into pathway 107 thereby impeding the passage of the user between chair 20 and pathway 107. With handle 71 pivoted downward from the position illustrated in FIG. 3A such that handle 71 is generally perpendicular to handrail section 56, foot member 75 is moved upward through bracket 78 and foot member end 79 of foot member 75 is disengaged from contact with floor 410 thereby placing brake mechanism 70 in released condition 72. Thus handle 71 is positioned to either impede passage of the user between chair 20 and pathway 107 (FIGS. 1 & 3C) or permit passage of the user between chair 20 and pathway 107 (FIG. 3A) as brake mechanism 70 is operated between released condition 72 and engaged condition 74, respectively.

With reference to FIG. 3B, handle 81, link 83, and foot member 85 of brake mechanism 80 (see FIG. 1) may cooperate with one another as brake mechanism 80 is operated between released condition 82 (see FIG. 1) and engaged condition 84 in a manner similar to that of handle 71, link 73, and foot member 75 of brake mechanism 70. As illustrated in FIG. 3B, brake mechanism 80 is in engaged condition 84, wherein foot end 89 of foot member 85 is biased against floor 410, which prevents rotation of platform 30 about base 40. Foot member 85 slides in bracket 88, as illustrated.

Figure 4:
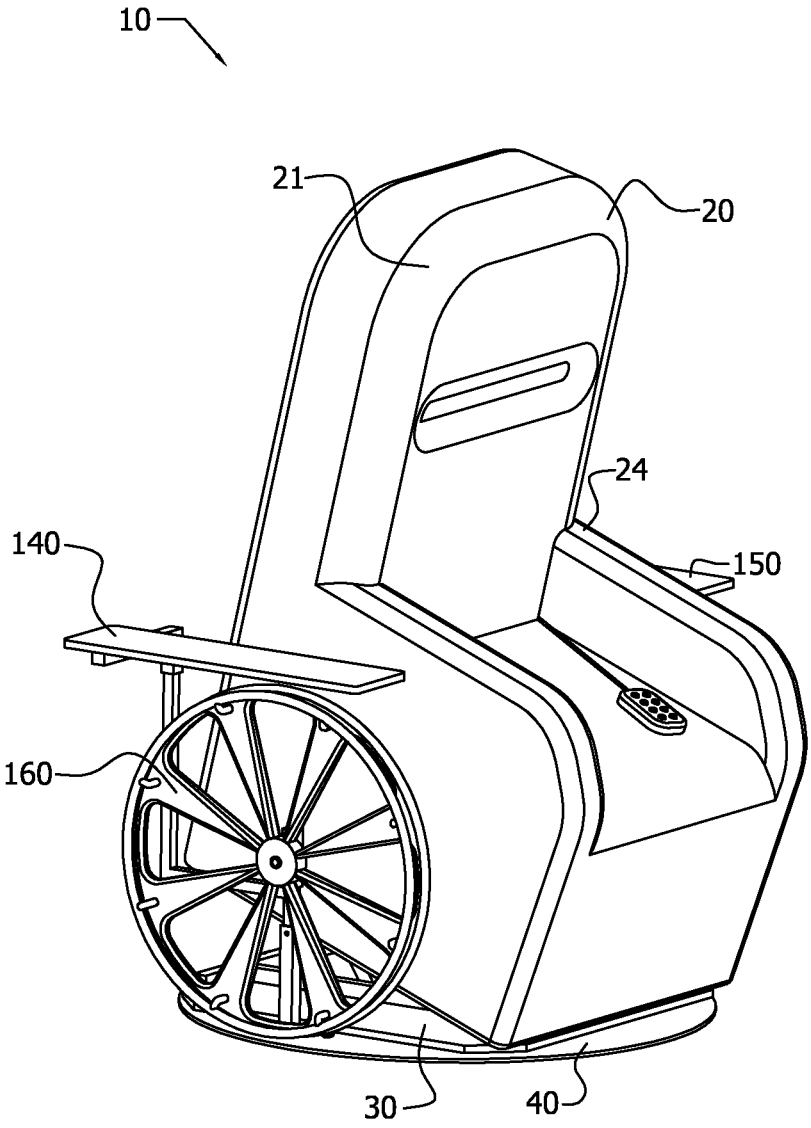
FIG. 4 illustrates by elevation view portions of the exemplary implementation of the user assistance including lift assist chair in a lifting position.

FIG. 4 illustrates chair 20 configured as lift assist chair 21 positioned in lifted chair position 24. With chair 20 positioned in lifted chair position 24, the user may be at least partially standing. Chair 20 in lifted chair position 24 is elevated above platform 30 in comparison to chair 20 in seated chair position 22, and chair 20 in lifted chair position 24 is tilted. The user may be seated in chair 20 with the chair in seated chair position 22 (see FIG. 1). As chair 20 is positioned from seated chair position 22 to lifted chair position 24, the user may be lifted, at least in part, from the sitting position into a standing position. Accordingly, chair 20 assists the user to move from the sitting position into the standing position as the chair is positioned from seated chair position 22 to lifted chair position 24. Similarly, the user in the standing position may access chair 20 in lifted chair position 24, and chair 20 may assist the user to move from the standing position into the sitting position as the chair is positioned from lifted chair position 24 into seated chair position 22. Various motors, controls, and so forth may be disposed about chair 20 and adapted to allow the user to position chair 20 between seated chair position 22 and lifted chair position 24.

Figure 6:
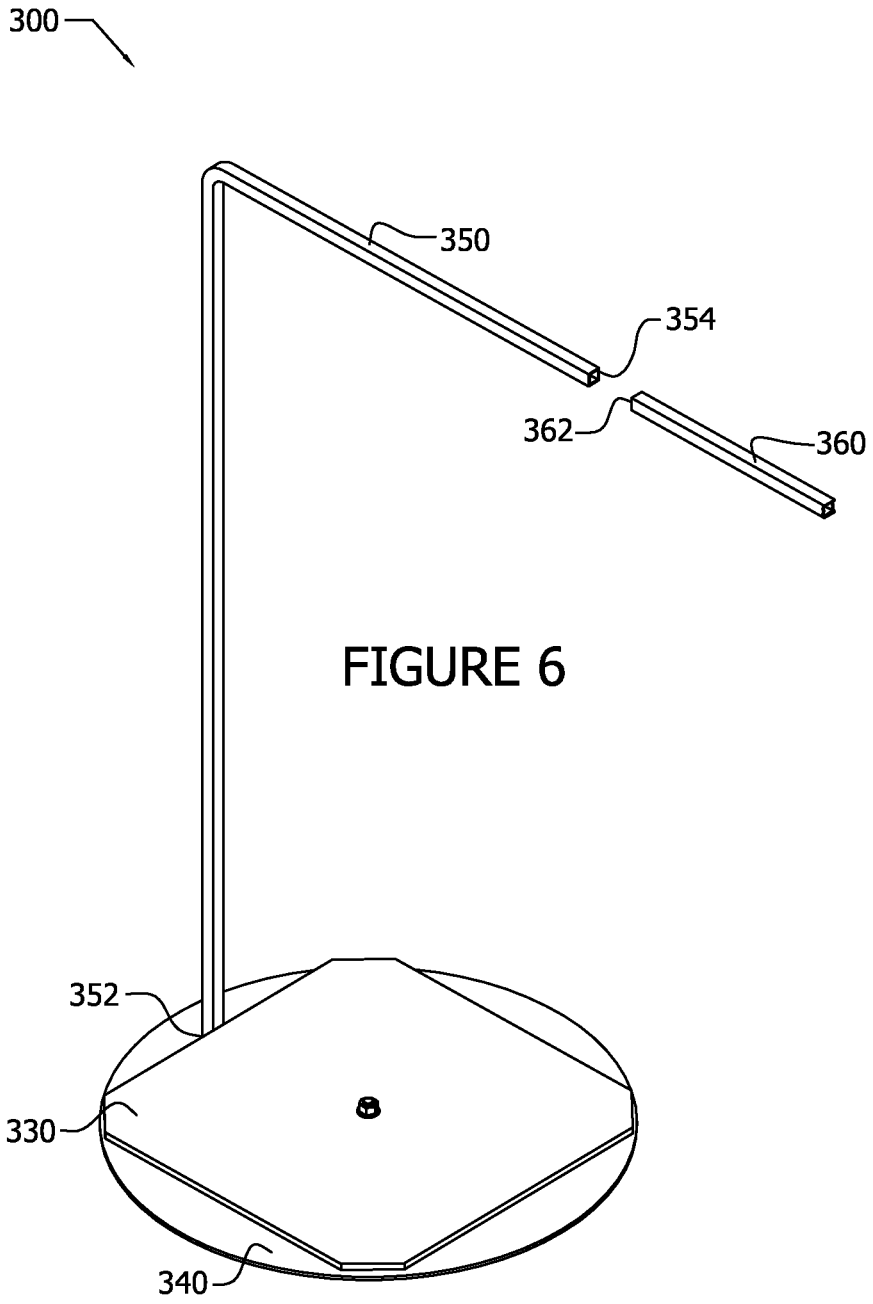
FIG. 6 illustrates by perspective view portions of an exemplary implementation of a user assistance apparatus including a trolley rail.

FIG. 6 illustrates portions of an implementation of user assistance apparatus 300. As illustrated in FIG. 3, user assistance apparatus includes platform 330 rotatably mounted upon base 340. A chair, such as chair 20, may be placed upon platform 330, and handrails, such as handrails 50, 60, 210, 220 may extend forth from platform 330. A trolley rail 350 is secured at end 352 to platform 330, as illustrated, and trolley rail 350 is configured such that portions of trolley rail 350 extend above a chair resting upon platform 330. Portions of trolley rail 350 may extend generally above a pathway, such as pathway 107, formed by handrails attached to platform 330. Trolley rail 350 rotates with platform 330, in this implementation. Trolley rail 350 may be secured to platform 330 by, for example, welds or mechanical connectors, in various implementations. Various structural supports (not shown) may be provided to support trolley rail 350 such that trolley rail 350 is structurally sufficient to support the user, as would be readily recognized by those of ordinary skill in the art upon study of this disclosure. The user may be connected to trolley rail 350 by a harness (not shown) configured to movingly engage trolley rail 350 such that the user is supported, at least in part, by connection of the harness to the trolley rail 350. The harness is adapted to removably fit about the user in various ways such that the user is secured to trolley rail 350 via the harness. The harness may traverse along trolley rail 350 as the user moves about, such that the trolley rail 350 supports the user via the harness when the user is so moving about. The trolley rail 350 may support the user via the harness as the user moves along the pathway. The user may wear the harness while seated in the chair such that the harness in combination with trolley rail 350 supports the user, for example, to prevent the user from tumbling out of the chair or to assist the user as the user enters or exits the chair.

Additional trolley rails, such as trolley rail 360, may be provided in various implementations, and the additional trolley rails may be located overhead about platform 330 and base 340. Trolley rail 360 may be secured, for example, to the ceiling to support the user via harness therefrom and to allow the user to traverse along trolley rail 360 under the support of the harness moveably attached to trolley rail 360. In some implementations, the user may rotate platform 330 such that end 354 of trolley rail 350 aligns with end 362 of trolley rail 360. With trolley rail 350 so aligned with trolley rail 360, the harness may be traversed between trolley rail 350 and trolley rail 360. Trolley rail 360 may then lead to various locations about a residence including other facility. Accordingly, the user may pass along trolley rail 350 and along trolley rail 360 while being supported by the harness, the harness being able to pass along trolley rail 350, along trolley rail 360, and between trolley rail 350 and trolley rail 360. The user may access various locations by engaging trolley rail 350 with a trolley rail, such as trolley rail 360, that leads to the location the user desires to access.

In operation, the user may be seated in a chair, such as chair 20, positioned on a platform, such as platform 30, 330 of a user assistance apparatus, such as user assistance apparatus 10, 300. The chair may be configured as a lift assist chair 21, and the chair may be in seated chair position 22 with the user seated therein. While seated in the chair, the user may access various devices positioned about a table, such as table 140, 150, secured about the platform, and the table may rotate with the platform. The user may use a grab-stick or other such reaching device (not shown) to access the table, or to access a fixture, such as fixtures 182, 183, 184, 185, 187, while seated in the chair.

With brake mechanism(s), such as brake mechanisms 70, 80, in a released condition, such as released condition 72, 82, the user may rotate the chair by rotation of the platform about a base, such as base 40. The user may rotate the platform about the base by rotating a wheel, such as wheel 160, coupled to the platform. The user may rotate the wheel by hand using a wheel rail, such as wheel rail 162. The wheel 160 may be positioned on either side of chair 20, in various implementations. Some implementations may include wheels, such as wheel 160, on platform 30 on both sides of chair 20. Alternatively, an electric motor (not shown) could be provided to rotate platform 30 about base 40.

The user may rotate the platform until the platform is oriented such that an entry, such as entry 110, to a pathway, such as pathway 107, is oriented toward a fixture, such as fixture 182, 183, 184, 185, 187, that the user wishes to access. The fixtures, such as fixture 182, 183, 184, 185, 187, may be positioned in a generally curved configuration, for example, to coincide generally with orientations of the entry as the platform is rotated about the base. With the platform so oriented, the user may place the brake mechanism(s) in an engaged position, such as engaged position 74, 84, to lock the platform in the orientation with the selected fixture. The user may place handrail sections, such as handrail sections 210, 220 into a position, such as positions 213, 223 to allow access to the pathway. The user may then place the chair from seated chair position 22 into lifted chair position 24, which may assist the user in rising from the sitting position in the chair into the standing position. The user may position the chair from a chair position, such as lifted chair position 24, into a chair position, such as seated chair position 22, which may assist the user in sitting from a standing position. The user in the standing position may then traverse between the chair and the fixture that the user wishes to access. The user in the standing position may pass between the chair and the entry and may use handrails, such as handrails 50, 60, for assistance while passing along the pathway between the chair and the entry. The user may use the handrails for assistance in standing, walking, or both standing and walking. The user may use the handrails for assistance while interacting with the fixture. The user may enter or exit the user assistance apparatus generally through the entry. The user may extend or contract the length of the handrails by extending or contracting handrails sections, such as handrail sections 59, 69, from other handrail sections, such as handrail sections 54, 64, and may do so as required to access a fixture.

While standing in the pathway, the user may place the brake mechanisms in the released condition, and then the user may push upon the handrail to rotate the platform about the base in order to position the platform. The user may adjust a resistance of an adjustable brake mechanically cooperating with the platform such that the resistance of the adjustable brake is generally negligible when thus positioning the platform. Alternately, the user may exercise by increasing the resistance of the adjustable brake to a desired resistance and then push upon the handrail to rotate the platform about the base.

Figure 5:
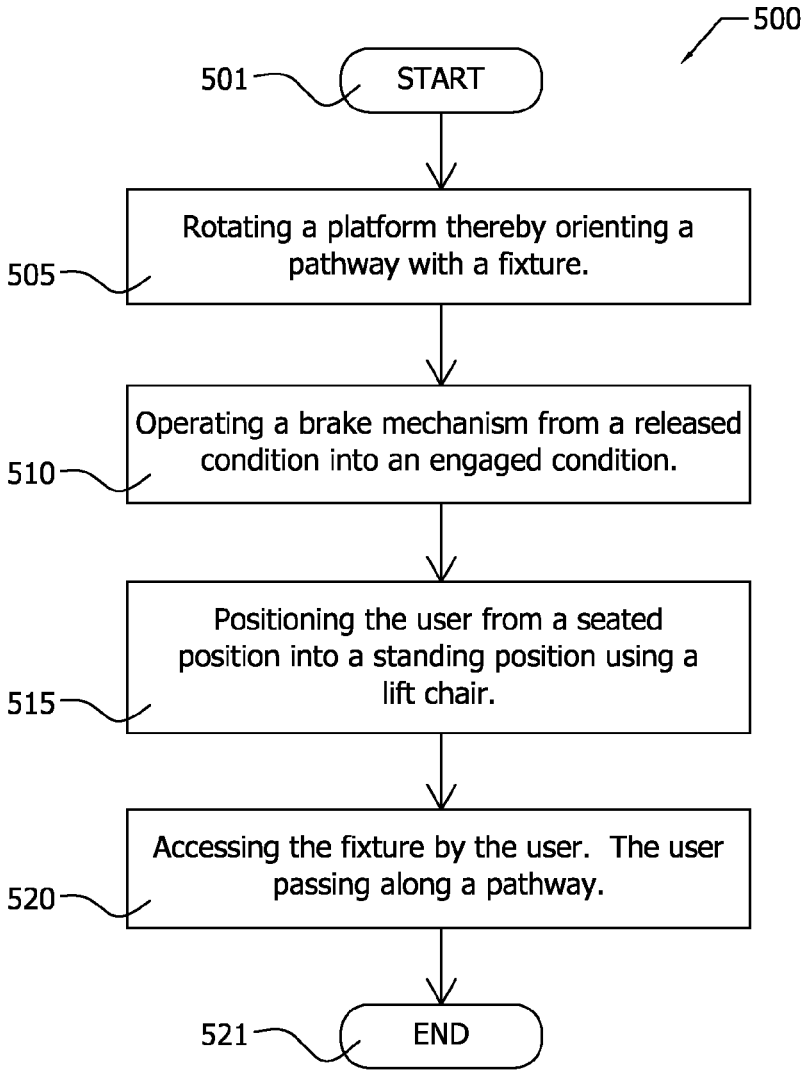
FIG. 5 illustrates by process flow chart an exemplary method of use of the exemplary user assistance apparatus.

FIG. 5 illustrates method 500 for accessing a fixture by a user, for example, using user assistance apparatus 10. Method 500 is accessed at step 501. At step 505, with the user seated in the lift assist chair on the platform, the user rotates the platform such that a pathway formed by handrails extending from the platform is oriented toward the fixture the user is desirous of accessing. The entry to the pathway may be oriented with the selected fixture, and the user may select the selected fixture from a number of fixtures.

At step 510 the user operates a brake mechanism from the released condition to the engaged condition to secure the platform in orientation with the selected fixture.

At step 515, the user is positioned from the seated position into the standing position using the lift assist chair.

At step 520, the user passes from the chair along the pathway to access the selected fixture. Method 500 terminates at step 521.

In various implementations, methods of use of the user assistance apparatus may, for example, include the steps of rotating a platform with a chair positioned thereupon, the platform being rotatably mounted upon a base, orienting an entry defined by the handrails with a fixture selected from a plurality of fixtures disposed in a generally semicircular arrangement about the perimeter, operating a brake mechanism between a released condition and an engaged condition, the brake mechanism mechanically cooperating with the platform such that the platform is freely rotatable about the base when the brake mechanism is in the released condition and the platform is fixed with respect to the base when the brake mechanism is in the engaged condition, positioning the user between a standing position and a sitting position using the chair, the chair being configured as a lift chair, traversing by a user between the chair and a perimeter, the user grasping parallel handrails mounted upon the platform and extending generally between the chair and the perimeter, and accessing the fixture by the user with the entry so oriented, the user passing between the handrails from the chair to the entry.

The foregoing discussion along with the Figures discloses and describes various exemplary implementations. These implementations are not meant to limit the scope of coverage, but, instead, to assist in understanding the context of the language used in this specification and in the claims. Upon study of this disclosure and the exemplary implementations herein, one of ordinary skill in the art may readily recognize that various changes, modifications and variations can be made thereto without departing from the spirit and scope of the inventions as defined in the following claims.

The invention claimed is:

1. A user assistance system, comprising:

a base;

a platform rotatably positionable about the base;

a chair disposed upon the platform;

handrails attached to the platform such that the handrails rotate with the platform, the handrails extend forth from the platform to define an entry, the handrails configured to assist a user as the user passes between the entry and the chair;

fixtures disposed in a generally curved arrangement to cooperate with the entry as the platform is rotatably positioned about the base; and a brake mechanism in mechanical cooperation with the platform and operable between a released condition and an engaged condition, the platform freely rotatable about the base when the brake mechanism is in the released condition, the platform held in fixed position with respect to the base when the brake mechanism is in the engaged condition, wherein the brake mechanism is adapted to bar passage between the chair and a pathway between the handrails when the brake mechanism is in the released condition and adapted to permit passage between the chair and the pathway between the handrails when the brake mechanism is in the engaged condition.

2. The system of claim 1, wherein the handrails are outwardly extensible with respect to the platform.

3. The system of claim 1, further comprising a wheel adapted to be turned by the user, the wheel in mechanical cooperation with the platform such that the platform rotates about the base as the wheel is turned.

4. The system of claim 1, further comprising an adjustable brake in mechanical cooperation with a wheel adapted to adjust the turning resistance of the wheel for the provision of exercise to the user.

5. The system of claim 1, further comprising a table affixed to the platform to rotate with the platform, the table accessible to the user when the user is seated in the lift assist chair.

6. The system of claim 1, wherein the fixtures include at least one of a sink, a refrigerator, a microwave oven, a cook top, an oven, a dishwasher, a laundry facility, a bed, a toilet.

7. A method of assisting a user, comprising the steps of:

rotating a platform with a chair positioned thereupon, the platform being rotatably mounted upon a base;

traversing by a user between the chair and a perimeter, the user grasping parallel handrails mounted upon the platform and extending generally between the chair and the perimeter; and operating a brake mechanism between a released condition and an engaged condition, the brake mechanism mechanically cooperating with the platform such that the platform is freely rotatable about the base when the brake mechanism is in the released condition and the platform is fixed with respect to the base when the brake mechanism is in the engaged condition, wherein the brake mechanism in the released condition blocks passage between the chair and the perimeter.

8. The method, as in claim 7, further comprising the step of positioning the user between a standing position and a sitting position using the chair, the chair being configured as a lift chair.

9. The method, as in claim 7, further comprising the steps of:

orienting an entry defined by the handrails with a fixture selected from a plurality of fixtures disposed in a generally semicircular arrangement about the perimeter; and accessing the fixture by the user with the entry so oriented, the user passing between the handrails from the chair to the entry.

10. A user assistance system, comprising:

a base;

a platform rotatably positionable about said base;

a chair supported on said platform;

a brake mechanism in mechanical cooperation with said platform and operable between a released condition and an engaged condition, said platform freely rotatable about said base when said brake mechanism is in said released condition, said platform held in fixed position with respect to said base when said brake mechanism is in said engaged condition;

a plurality of fixtures arranged circumferentially about said platform, each of said plurality of fixtures spaced from said platform;

a first handrail attached to said platform such that said first handrail rotates with said platform, said first handrail extending outwardly beyond said platform toward said plurality of fixtures; and a second handrail attached to said platform such that said second handrail rotates with said platform, said second handrail extending outwardly beyond said platform parallel to said first handrail toward said plurality of fixtures;

wherein a pathway is formed between said first handrail and said second handrail, said pathway open on both ends so that a user can pass completely through said pathway;

wherein said chair is rotatable with said platform such that said chair can be aligned with one of said plurality of fixtures so that the user can move between said chair and said one of said plurality of fixtures through said pathway to access said one of said plurality of fixtures;

wherein said first handrail and said second handrail are operable to support the user in a standing position as the user moves between said chair and said one of said plurality of fixtures through said pathway;

wherein said brake mechanism is operable to bar passage between said chair and said pathway when said brake mechanism is in said released condition and is further operable to permit passage between said chair and said pathway when said brake mechanism is in said engaged condition.

11. A system according to claim 10, further comprising a wheel in mechanical cooperation with said platform, said wheel operable by a user to rotate said platform about said base.

12. A system according to claim 10, further comprising an adjustable brake in mechanical cooperation with a wheel, said adjustable brake operable by a user to adjust a turning resistance of said wheel for the provision of exercise to the user.

13. A system according to claim 10, wherein said plurality of fixtures includes a sink, a refrigerator, a microwave oven, a laundry facility, a bed, and a toilet.

14. A system according to claim 10, wherein said first handrail and said second handrail are outwardly extensible with respect to said platform.

15. A system according to claim 10, further comprising an electrical supply system for supplying electrical power to said user assistance system, said electrical supply system including a rigid hollow tube extending from said chair toward said ceiling for receiving electrical transmission cords therethrough.

16. A system according to claim 10, wherein said chair is a lift assist chair for moving a user between a standing position and a sitting position.

* * * * *